US011243055B2

(12) United States Patent
Plummer

(10) Patent No.: US 11,243,055 B2
(45) Date of Patent: Feb. 8, 2022

(54) SPORTING APPARATUS

(71) Applicant: Gravity Brands Limited, Harlow (GB)

(72) Inventor: Garry Plummer, Harlow (GB)

(73) Assignee: Gravity Brands Limited, Essex (GB)

( * ) Notice: Subject to any disclaimer, the term of this patent is extended or adjusted under 35 U.S.C. 154(b) by 0 days.

(21) Appl. No.: 16/516,887

(22) Filed: Jul. 19, 2019

(65) Prior Publication Data

US 2020/0088501 A1 Mar. 19, 2020

(30) Foreign Application Priority Data

Sep. 14, 2018 (GB) ..... 1814952
Feb. 18, 2019 (GB) ..... 1902188

(51) Int. Cl.
*F42B 6/00* (2006.01)

(52) U.S. Cl.
CPC ..... *F42B 6/003* (2013.01)

(58) Field of Classification Search
CPC .. F42B 6/003; F42B 6/00; F42B 12/38; F42B 12/385
USPC ..... 473/578, 579, 582
See application file for complete search history.

(56) References Cited

U.S. PATENT DOCUMENTS 5,967,915 A * 10/1999 Lu ..... F42B 6/003 473/578
2008/0287229 A1* 11/2008 Donahoe ..... F41B 5/14 473/570

FOREIGN PATENT DOCUMENTS

GB 1486921 A * 9/1977 ..... F42B 6/003
GB 1486921 A 9/1977
GB 2232901 A 1/1991

* cited by examiner

*Primary Examiner* — John E Simms, Jr.
*Assistant Examiner* — Rayshun K Peng
(74) *Attorney, Agent, or Firm* — Martin IP Law Group; C. Richard Martin

(57) ABSTRACT

A dart point, the dart point having a distal end, a middle portion and a proximal end; wherein: the distal end is tapered to a point; the middle portion is substantially cylindrical; and the proximal end comprises a generally incompressible tapered retaining portion having a substantially continuous tapered retaining surface, being generally frustoconical, wherein the taper becomes narrower in the direction passing from the distal end to the proximal end of the dart point.

17 Claims, 2 Drawing Sheets

SPORTING APPARATUS

DESCRIPTION OF INVENTION

This invention relates to darts, in particular the connection between a dart point and a dart barrel.

Many darts players use replaceable dart points as dart points tend to wear down with repeated use or snap if the dart bounces out of a dartboard onto a hard floor. Typically, a dart point with a cylindrical shaft may be used. The dart point is held in a dart barrel by the friction between the cylindrical shaft and the inside of the dart barrel. A dart repointing tool is typically required to remove the dart point from the dart barrel, and many dart players may not own or have access to such a tool.

More recently, dart points that screw into the dart barrel have started to be used. If dart points which screw into a dart barrel are used, it is common for the darts points to become loose due to the repeated impact of the dart point in a dartboard.

Dart points which require a re-pointing tool are much less likely to become loose with repeated impact due to a tight fit in the dart barrel, but are inconvenient as they require an expensive tool to replace the dart point.

When a dart point snaps, it is common for it to snap at the point where the dart point meets the dart barrel. This means that it is not easily removable as the snapped dart point is flush or nearly flush with the dart barrel, and there is no protruding feature to grip onto in order to remove the dart point.

It is recognised in the art that there is a need for a dart point that is readily replaceable, even if the dart point has snapped, and reliably stays within the dart barrel with repeated use.

It is desirable to have a dart point that is easily replaceable, even if the dart point has snapped, in order to be able to exchange the dart point once it becomes blunt, or if it has snapped, and at the same time, the dart point should remain in place with repeated use.

The present invention aims to address at least some of these problems.

Accordingly, one aspect of the present invention provides a dart point, the dart point having a distal end, a middle portion and a proximal end; wherein: the distal end is tapered to a point; the middle portion is substantially cylindrical; and the proximal end comprises a generally incompressible tapered retaining portion having a substantially continuous tapered retaining surface, being generally frusto-conical, wherein the taper becomes narrower in the direction passing from the distal end to the proximal end of the dart point.

Advantageously, the tapered retaining surface comprises a locking taper and the angle of the taper is from 1° to 20° to the longitudinal axis of the dart point.

Preferably, the tapered retaining surface comprises a locking taper and the angle of the taper is from 3° to 15°, and preferably wherein the tapered retaining surface comprises a locking taper and the angle of the taper is from 5° to 10°.

Conveniently, the tapered retaining surface comprises a locking taper and the angle of the taper is from 6.5° to 7.5°, and preferably wherein the tapered retaining surface comprises a locking taper and the angle of the taper is 7° or substantially 7°.

Advantageously, the dart point may be attached to a dart barrel solely or primarily through a frictional connection between the locking taper and a corresponding tapering surface within the dart barrel, and preferably wherein no other cooperating engagement parts are used to attach the dart point to the dart barrel.

Preferably, the tapered retaining surface is a stabilising surface and the angle of the taper is from 10° to 60° to the longitudinal axis of the dart point.

Conveniently, the angle of the tapered retaining surface is between 30° and 60°, and preferably wherein the angle of the tapered retaining surface is between 40° and 50°, and more preferably wherein the angle of the tapered retaining surface is 45° or substantially 45°.

Advantageously, the angle of the tapered retaining surface is between 10° and 20°, and preferably wherein the angle of the tapered retaining surface is between 10° and 15°, and more preferably wherein the angle of the tapered retaining surface is between 10° and 12° or substantially between 10° and 12°.

Preferably, the proximal end comprises two generally incompressible tapered retaining portions, each having a substantially continuous tapered retaining surface, being generally frusto-conical, wherein the taper becomes narrower in the direction passing from the distal end to the proximal end of the dart point, and preferably wherein the dart point comprises a first tapered retaining surface and a second tapered retaining surface, wherein the first and second tapered retaining surfaces are spaced apart from each other in a direction parallel with the longitudinal axis of the dart point.

Conveniently, the angle of taper of the first and second tapered retaining surfaces is the same or substantially the same.

Advantageously, the angle of taper of the first tapered retaining surface is different from the angle of taper of the second tapered retaining surface.

Preferably, the or each tapered retaining surface is substantially straight in cross-section.

Conveniently, the proximal end further comprises a joining part which, in use, fits into a dart barrel, and preferably wherein the joining part further comprises a thread, useable to screw the dart point to a dart barrel.

Advantageously, the tapered retaining surface is between the middle portion and the joining part.

Preferably, the joining part is between the middle part and the tapered retaining surface.

Advantageously, the middle portion includes a gripping profile, which comprises a region of the middle portion having a cross-sectional shape including one or more flat or substantially flat surfaces.

Preferably, the middle portion includes a weakened portion, comprising a region of the middle portion which is weaker than other regions of the middle portion.

Conveniently, the weakened portion has a cross-section which is thinner in at least one direction compared to the cross-section of regions of the middle portion immediately surrounding the weakened portion.

Advantageously, the weakened portion comprises one or more grooves formed in the middle portion.

Preferably, the weakened portion is further towards the point than the gripping profile.

Another aspect of the invention provides a dart barrel, the dart barrel having a proximal end, a middle portion and a distal end; wherein: the proximal end of the dart barrel has an aperture with a tapered region, wherein the tapered region becomes narrower in the direction passing from the proximal end to the distal end of the dart barrel; and the aperture is configured to receive a dart point, such that the proximal end of the dart point is securable in the proximal end of the dart barrel.

Conveniently, the aperture further comprises a void, the void being a continuation of the aperture, the void extending from the taper of the dart barrel towards the distal end of the dart barrel and the void being configured to receive the joining part of a dart point, and preferably wherein the void has a thread such that a threaded joining part of a dart point can be screwed into the dart barrel.

A further aspect of the invention provides a combination of the dart point of any one of the above and the dart barrel of any of the above, wherein the angle of the tapered retaining surface and the angle of the tapered regions of the aperture of the dart barrel are the same.

Advantageously, the angle of the taper of the tapered retaining surface is such that if the dart point hits a hard surface and snaps, the force of the impact releases the remaining part of the dart point from the dart barrel.

Another aspect of the present invention provides a method of assembling a dart, the method comprising the steps of: providing a dart point in accordance with any one of the above; providing a dart barrel in accordance with any of the above; and attaching the dart point to the dart barrel so that the tapered surfaces lock together.

In order that the present invention may be more readily understood, embodiments thereof will now be described, by way of example, with reference to the accompanying drawings, in which.

Figure 1:
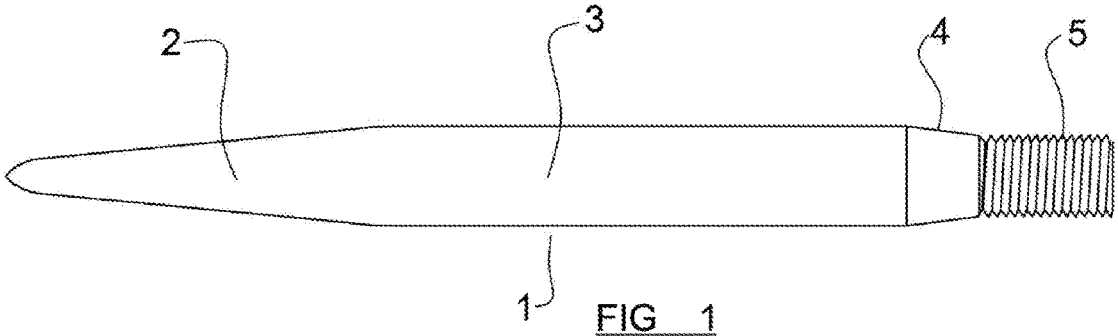
FIG. 1 is a schematic view of a dart point according to an embodiment of the present invention.

The embodiment shown in FIG. 1 comprises a dart point 1. The dart point 1 comprises a tapered point 2 at a distal (or front) end, a shaft 3 (which is cylindrical in the example of FIG. 1 but may take any suitable form), a tapered retaining surface 4 near a proximal (or rear) end of the dart point 1 and a joining part 5 with a screw thread at the proximal end of the dart point. The shaft 3 connects and extends between the tapered point 2 and the tapered retaining surface 4. The rear end of the shaft 3 may meet the widest part of the tapered retaining surface 4, as shown in FIG. 1, or a step may be present wherein the cross-sectional diameter of the shaft 3 and the cross-sectional diameter of the start of the tapered retaining surface 4 are substantially different.

The tapered retaining surface 4 becomes narrower in the direction passing from the tapered point 2 to the proximal end of the dart point 1. In some embodiments, the tapered retaining surface 4 is substantially straight in cross-section. In other embodiments, the proximal end of the dart point 1 is solid and the tapered retaining surface 4 is continuous, that is there are no breaks in the tapered retaining surface 4. The "Bottlesen Hammer Head" dart point is an example of a dart point with a proximal end that is not continuous and comprises some spaced apart tabs that may be compressed or flexed inwardly. In some embodiments, the proximal end of the dart point 1 may comprise two or more separate parts, each part joined at one end to the shaft 3, and the tapered retaining surface 4 is not continuous.

The proximal end of the dart point 1 may comprise a tapered retaining portion, an outer surface of which comprises the tapered retaining surface 4. The tapered retaining portion may be generally incompressible, i.e. if radial inward forces are applied to the retaining portion, such as when the retaining potion is used to fix the dart point 1 into a dart barrel, it retains substantially the same shape as when the dart point 1 is separate from a dart barrel. The "Bottelsen Hammer Head" dart point is an example of a dart point with a proximal end that is compressible.

The joining part 5, shown in the embodiment in FIG. 1 is optional. The joining part 5 is generally cylindrical, with a cross-sectional diameter that is smaller than that of the shaft 3. The screw thread of the joining part 5, as shown in FIG. 1, is also optional—the joining part 5 may alternatively have no thread.

The dart point 1 may optionally comprise a rubber O-ring. The O-ring may be located where the shaft 3 meets the tapered retaining surface 4, where the tapered retaining surface 4 meets the joining part 5 or at any intermediate location between the shaft 3 and the proximal end of the dart point 1. In order to retain the O-ring, there may be a corresponding indent in the dart point 1. In other embodiments, the O-ring may be a metal, a plastic, a ceramic or any other suitable material. Some embodiments may comprise more than one O-ring on the joining part, for example two, three, four or five O-rings.

In some embodiments, the shaft 3 of the dart point 1 may comprise a number of grooves, indents or general patterned areas in order to improve the grip, and/or feel for a user.

In other embodiments, the shaft 3 of the dart point 1 may comprise a tapered section, before the start of the tapered retaining surface 4. This additional taper may become wider in the direction passing from the distal end to the proximal end. The wide end of the taper may have a larger cross-sectional area than the shaft 3. This additional taper may be generally frusto-conical and/or otherwise flared.

Figure 2:
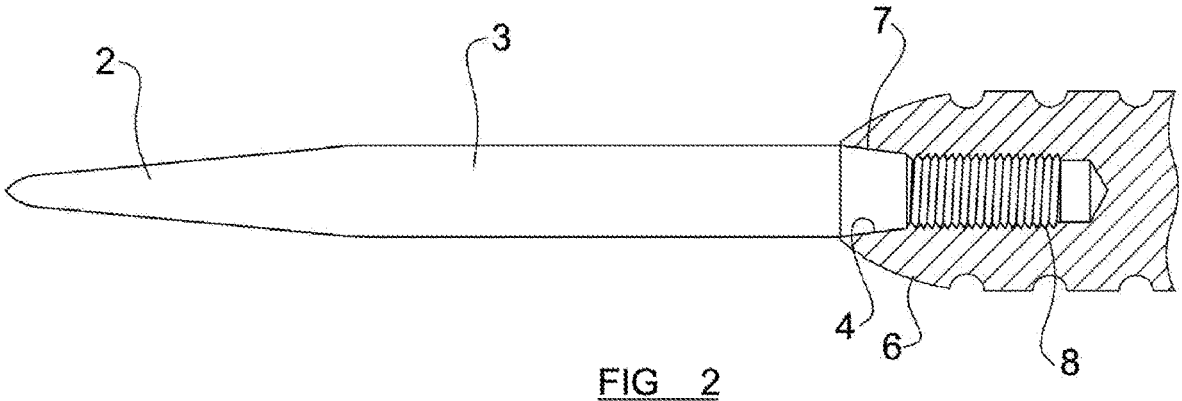
FIG. 2 is a schematic view of the dart point of FIG. 1 attached to a dart barrel.

The embodiment shown in FIG. 2 comprises the dart point 1, as shown in FIG. 1, attached in a dart barrel 6 (only the front part of which is shown). The dart barrel 6 comprises a proximal end (i.e. front), a middle portion and a distal end. At the proximal end of the dart barrel 6, there is an opening into which the dart point 1 may be inserted and attached to the dart barrel 6.

The dart barrel 6 further comprises a tapered aperture 7. Preferably, the widest part of the tapered aperture 7 forms the opening in the proximal end of the dart barrel 6. The taper of the aperture 7 becomes narrower in the direction passing from the proximal end to the distal end of the dart barrel 6.

The embodiment shown in FIG. 2 further comprises an optional void 8, the void 8 being a continuation of the tapered aperture 7, closer to the distal end than the tapered aperture 7. The void 8 may also optionally have a screw thread as shown in FIG. 2.

In embodiments where the dart point 1 comprises a threaded joining portion 5, the void 8 of the dart barrel 6 has a corresponding thread. The length of the threaded void 8 is at least as long as the threaded joining portion 5.

In embodiments where the dart point 1 comprises a joining portion 5 without a thread, the void 8 of the dart barrel 6 does not have a thread. The length of the void 8 is at least as long as the joining portion 5.

Use of the dart point 1 and the dart barrel 6 will now be discussed.

The dart point 1 is removably attachable to the dart barrel 6 by inserting the tapered retaining surface 4 of the dart point 1 into the tapered aperture 7 of the dart barrel 6. The user may twist the dart point 1 as the tapered retaining surface 4 is inserted into the tapered aperture 7 of the dart barrel 6. The dart point 1 is held in place by the interaction between the tapered retaining surface 4 and the tapered aperture 7.

If the dart point 1 does not comprise a joining portion 5, the user simply inserts and twists the tapered retaining surface 4 into the tapered aperture 7 in order to secure the dart point 1 in place.

In some embodiments, the dart point 1 may further comprise the joining part 5. As discussed above, the joining part 5 may optionally comprise a screw thread. If the joining part 5 comprises a thread, when joining the dart point 1 to the dart barrel 6, the user screws the dart point 1 into the dart barrel 6, which in turn draws the two parts together, so that the two parts are held in place by the tapered retaining surface 4 and the tapered aperture 7.

If the joining part 5 does not comprise a screw thread, the joining part 5 is simply inserted into the corresponding void 8 of the dart barrel 6. The joining part may be used to help a user align the tapered retaining surface 4 with the tapered aperture 7 of the dart barrel 6. The user simply twists the dart point 1 when inserting the tapered retaining surface 4 into the tapered aperture 7 in order to secure the dart point 1 in place. In some embodiments, the joining part 5 may closely fit in the void 8 and the additional friction may help hold the dart point 1 in place. In other embodiments, the joining part may loosely fit in the void 8 and may simply be a guide for the user.

The taper of the tapered retaining surface 4 may be at an angle of between 1° and 20°, such that the tapered retaining surface 4 of the dart point 1 is generally frusto-conical. The angle of the tapered retaining surface 4 is measured with respect to the longitudinal axis of the dart point 1. The tapered aperture 7 of the dart barrel 6 has a taper that matches the taper of the tapered retaining surface 4 of the dart point 1.

In some embodiments, the angle of the taper of the tapered retaining surface 4 is a locking taper and is from 1° to 20°, in other embodiments the angle of the taper is from 3° to 15°, in some embodiments the angle of the taper is from 5° to 10°, in other embodiments the angle of the taper is from 6.5° to 7.5° and in some embodiments, the angle of the taper is 7°.

In some embodiments, the angle of the taper of the tapered retaining surface 4 is such that if the dart point 1 hits a hard surface and snaps, for example at the point where the dart point 1 enters the dart barrel 6, the force of the impact releases the remaining part of the dart point 1 from the dart barrel 6. This effect may be achieved through use of a taper of 7°, or around 7°, as discussed above, but may also be achieved through other taper angles.

If the joining part 5 further comprises the optional O-ring, as described above, the friction between the O-ring and tapered aperture 7 may further aid with securing the dart point 1 in place.

An advantage of using corresponding tapers to join the dart point 1 to the dart barrel 6 is that the dart point 1 stays in place with repeated use. Further, it is easy for a user to replace the dart point 1 without the need for a specialist tool.

Figure 3:
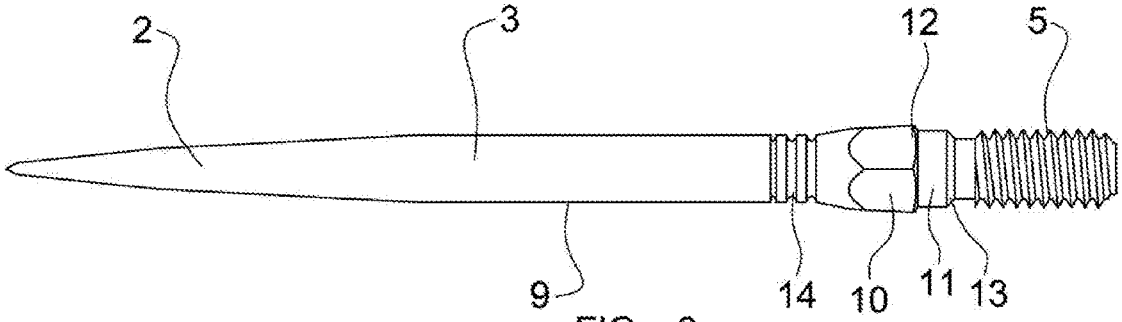
FIG. 3 shows a second dart point embodying the present invention.

Turning to FIG. 3, a second dart point 9 is shown. In common with the first dart point 1 described above, the second dart point 9 has a tapered point 2 at a distal (front) end, and a shaft 3. A main region of the shaft 3, immediately behind the point 2, is preferably cylindrical. Towards a distal (rear) end of the shaft 3, the shaft has a gripping profile 10. The gripping profile 10 comprises a portion of the shaft 3 which is shaped to facilitate the gripping and rotation of the shaft 3. In preferred embodiments, the gripping profile 10 comprises a region of the shaft 3 having a cross-sectional shape including one or more flat or substantially flat surfaces, e.g. resembling the cross-sectional outer profile of a nut. However, in other embodiments, the gripping profile 10 may comprise, for example, a region of the shaft 3 which is generally cylindrical apart from a pair of opposing flattened surfaces, which would allow the gripping profile 10 to be gripped easily by, for instance, a pair of pliers.

In the example shown in FIG. 3 the gripping profile 10 protrudes outwardly in a radial direction from the shaft 3, i.e. at least parts of the gripping profile 10 are wider than the main part of the shaft 3. This would allow, for instance, a spanner of a suitable size to be slid over the tapered point 2 and along the main part of the shaft 3, and to engage with the gripping profile 10.

However, in other embodiments, the gripping profile 10 may be formed by removing parts of the shaft 3, for instance to form flattened surfaces, and in this case parts of the gripping profile 10 may be narrower, in a radial direction, than the main part of the shaft 3.

An intermediate portion 11 is formed rearwardly of the gripping profile 10. In the embodiment shown, the intermediate portion 11 is cylindrical, and axially aligned with the main part of the shaft 3. The intermediate portion 11 is preferably narrower than the gripping profile 11. In the example shown in FIG. 3, the intermediate portion 11 is of substantially the same diameter as the barrel 3.

A first rearward-facing shoulder surface 12 is formed between the gripping profile 10 and the intermediate portion 11. The shoulder surface 12 is set at an angle with respect to the longitudinal axis of the barrel 3. In the example shown in FIG. 3, the first shoulder surface 12 is set at an angle of 45° or around 45°, or although in other embodiments this angle may between 30° and 60°.

Rearwardly of the intermediate portion 11 is a joining part 5, comprising a generally cylindrical protrusion. In preferred embodiments, at least a portion of the joining part 5 has threaded outer surface. The joining part 5 is similar to that of the first dart point 1 shown in FIGS. 1 and 2.

Where the joining part 5 meets the intermediate portion 11, the joining part 5 is radially narrower than the intermediate portion 11, and a second rearward-facing shoulder surface 13 is formed. Once again, the second shoulder surface 13 is set at an angle of 45°, or around 45°, to a longitudinal axis. This angle may also be between 30° and 60°, however.

In common with the first dart point 1 shown in FIGS. 1 and 2, the second dart point 9 is intended to be connected to the front end of a barrel (not shown). The barrel has an aperture centrally positioned on its front surface, similar to the one shown in FIG. 2, the aperture having a threaded bore of suitable dimensions to receive the threaded outer surface of the joining part 5, and also tapered receiving surfaces which match the sizes and angles of the first and second shoulders 12, 13.

It has been found that when the second dart point 9 is screwed into the barrel, the two tapered shoulders 12,13 assist in stabilising and centralising the point 9 in the aperture on the front of the barrel, and also in forming a tight and reliable fit between the dart point 9 and the barrel. This will ensure that there is little or no "play" between the dart point 9 and the barrel, and also that the dart point 9 does not become loosened with respect to the barrel with repeated use.

In the example shown in FIG. 3, positioned on the barrel 3 forwardly of the gripping profile 10 (i.e. closer to the distal end than the gripping profile), three grooves 14 are formed. These grooves are formed to be narrower than the main part of the barrel 3. In the example shown, the grooves 14 are each 0.3 mm in length, and have a depth of 0.15 mm-0.2 mm, although the invention is not limited to this and other widths and depths of grooves may be used.

The grooves 14 are provided so that, if the dart is dropped, or falls/bounces out of a dart board following a throw and lands tip-first on a hard surface, the point 9 will preferentially snap in the region of the grooves 14. Since the grooves 14 are provided forwardly of the gripping profile 10, this will still leave the gripping profile exposed, protruding from the front of the barrel. This can then be readily grasped by a user (using a suitable tool, if required), and the remaining parts of the point 9 can then be easily removed from the barrel, to be replaced by a new point. This will help to prevent the situation where the point 9 snaps at a point which is substantially flush with the front of the barrel, thus leaving no protruding part that can be gripped to remove the remaining part of the point 9.

The invention is not limited to grooves, and an alternative point of weakness may be formed on the shaft 3 of the point. For instance, part of the material of the shaft 3 may be cut away in a manner that is not circumferentially uniform. However, it is preferred to provide a point of weakness which comprises one or more grooves, as this will provide a pleasing symmetrical appearance. It is important, as the skilled reader will appreciate, that the point of weakness does not interfere with the normal operation of the dart, i.e. will not cause the shaft 3 to bend or distort in an unusual way during use, or affect the flight, accuracy or "feel" of the dart.

The combination of a gripping profile formed on the shaft, and a point of weakness which is formed closer to the point than the gripping profile, may be used with other designs of dart point, i.e. including designs which do not have any tapered surfaces formed as part of a joining arrangement to join the dart point to a barrel. This combination of features may be used with any style or design of dart which has a removable and/or replaceable point.

Figure 4:
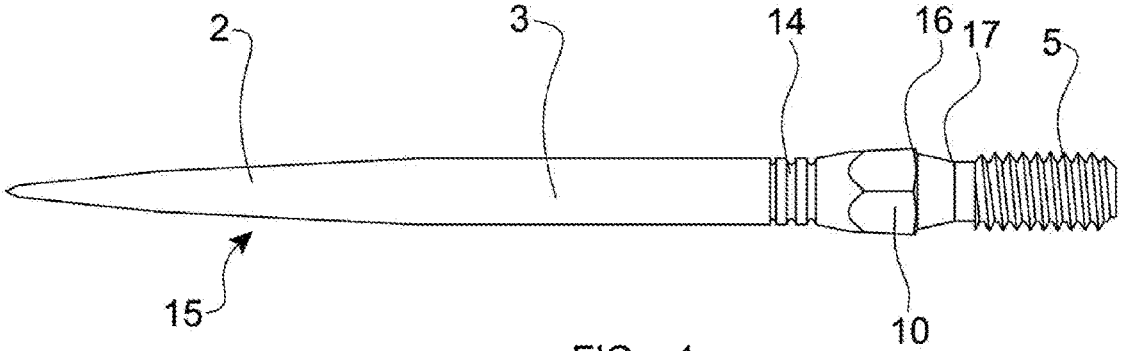
FIG. 4 shows a third dart point embodying the present invention.

FIG. 4 shows a third dart point 15 embodying the present invention. The tapered point 2, shaft 3, gripping profile 10 and joining part 5 are identical to those of the second dart point 9 shown in FIG. 3. However, between the gripping profile 10 and the joining part 5, two alternative tapered shoulders are formed.

A first tapered shoulder 16 is formed rearwardly (in the example shown in FIG. 4, immediately rearwardly) of the gripping profile 10. The first shoulder surface 16 is set at an angle of 45° or around 45°, or although in other embodiments this angle may between 30° and 60°.

Rearwardly of the first tapered shoulder 16 (in the example shown in FIG. 4, again immediately rearwardly) is a second tapered shoulder 17. The second tapered shoulder surface 17 is set at a shallower angle than the first tapered shoulder surface 16, and in this example is set at an angle of 10-12°, or around 10-12°. The second tapered shoulder surface 17 is also preferably longer than the first tapered shoulder surface 16. In the example shown, the first tapered surface 16 has a length of around 0.2 mm, and the second tapered surface 17 has a length of around 1.2-1.5 mm. The invention is not limited to these lengths, however. In preferred embodiments the second tapered surface 17 has a length which is around 5-10 times, and more preferably 6-8 times, the length of the first tapered surface 16.

In the embodiment shown in FIG. 4, a relatively short tapered surface, which is set at a relatively steep angle, is provided closer to the shaft 3, and a relatively long tapered surface, which is set at a relatively shallow angle, is provided closer to the joining part 5. However, this may be reversed, and in other embodiments a relatively long tapered surface, which is set at a relatively shallow angle, may be provided closer to the shaft 3, and a relatively short tapered surface, which is set at a relatively steep angle, is provided closer to the joining part 5.

It has been found that a combination of two tapered surfaces, for instance as shown in FIGS. 3 and 4, is also effective in centralising the dart point 15 with respect to a barrel, in forming a tight and reliable fit between the dart point 15 and the barrel, and preventing the dart point 15 from becoming loosened with respect to the barrel with repeated use. However, one stabilising tapered surface of this kind may also be effective in forming a more reliable connection between the dart point and a barrel.

It is also envisaged that three or more tapered surfaces may be formed, and that this will increase still further the reliability of the connection between the dart point and a dart barrel. The skilled reader will readily understand how a dart point having three or more tapered surfaces may be formed.

Figure 5:
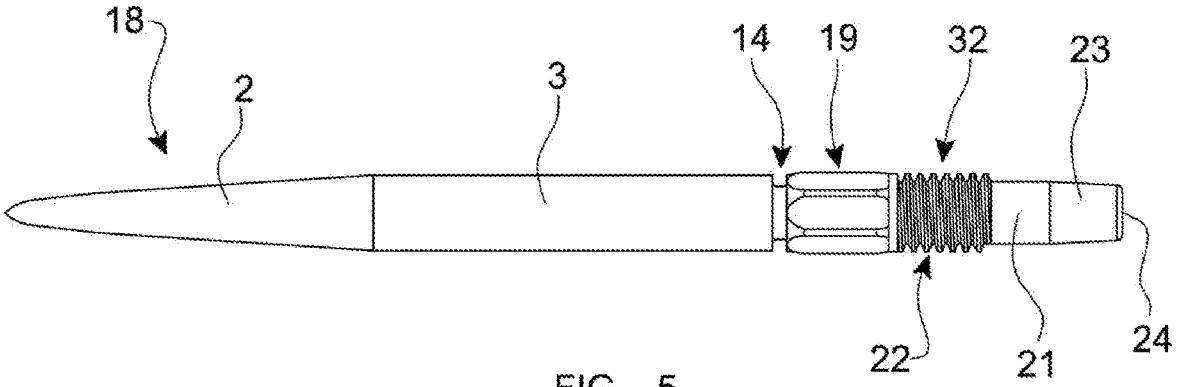
FIG. 5 shows a fourth dart point embodying the present invention.

FIG. 5 shows a fourth dart point 18 embodying the present invention. The tapered point 2 and shaft 3 are identical to those of the second and third dart points 9, 15 shown in FIGS. 3 and 4. In this example only a single groove 14 is provided at the rear end of the shaft 3, instead of the three grooves shown in the examples above, although the formation and function of this single groove 14 is similar to that explained in connection with these earlier examples.

At the rear end of the shaft 3, the fourth dart point 18 has a gripping profile 19 which, as discussed above, is shaped to be gripped and rotated by a suitable tool. The gripping profile 19 protrudes outwardly from the shaft 3, as is the case for the second and third dart points 9, 15, and is formed by a series of flattened surfaces 20. In other examples, however, it is envisaged that the gripping profile may not protrude outwardly from the shaft 3, and in these examples the flattened surfaces will fall within the cross-sectional area of the shaft 3. In these examples, no part of the gripping profile 19 extends outwardly with respect to the shaft 3.

Rearwardly of the gripping profile 19, the fourth dart point 18 has a joining part 32 which includes a rod 21 of constant or substantially constant diameter, which is concentric with the shaft 3, and has a diameter less than that of the shaft 3. The rod 21 has a threaded portion 22 formed thereon, with a screw thread that protrudes outwardly from the rod 21. In the embodiment shown, the threaded portion 22 of the rod 21 is positioned immediately behind the side of the gripping profile 9 and, although this is not essential and in other embodiments there may be a length of the rod 21 between these two components.

The rod 21 preferably continues rearwardly of the threaded portion 22. A tapered region 23 is formed at the rearward end of the rod 21. The tapered region 23 tapers inwardly, i.e. becomes narrower towards its rearward end, and terminates in a flat or substantially flat rear end 24.

In preferred embodiments, the angle of taper of the tapered region 23 is 7° or around 7°, but in other embodiments this angle may be between 1° and 20°, more preferably between 3° to 15°, still more preferably between 5° and 10°, and yet more preferably between 6.5° and 7.5°.

Figure 6:
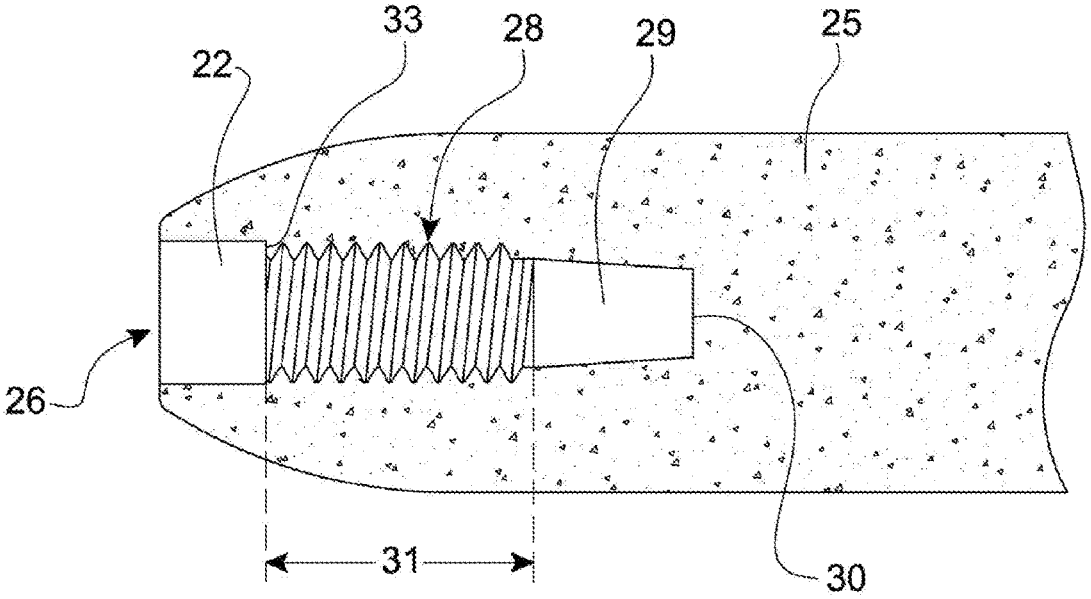
FIG. 6 shows a dart barrel adapted to receive the fourth dart point.

FIG. 6 shows the front end of a dart barrel 25 which is adapted to receive and retain the fourth dart point 18. The barrel 25 has an aperture 26 at the centre of its front end, into which the rear end of the fourth dart point 18 may be inserted.

The aperture 26 has a front portion 27, which is generally cylindrical and has an internal diameter which is substantially the same as, or slightly greater than, the diameter of the gripping profile 19. The aperture 26 also has a middle portion 31, behind the front portion 27, which has an internal diameter which is substantially the same as, or slightly greater than, the diameter of the rod 21. A shoulder 33 is formed where the front portion 27 meets the middle portion 31 The middle portion 31 has a threaded portion 28, having screw threads which are adapted to match and engage with the threads of the threaded portion 22 formed on the rod 21.

Rearwardly of the middle portion 31 is a rear portion 29, which tapers inwardly and terminates in a dead end 30. The angle of taper of the rear portion 29 is preferably the same or substantially the same as that of the tapered region 23 at the rear of the fourth dart point 18.

In order to attach the fourth dart point 18 to the front of the barrel 25, the joining part 32 is inserted into the aperture 26 of the barrel 25. When the threaded portions 22, 28 of the dart point 18 and the middle portion 31 meet each other, the dart point 18 is rotated relative to the barrel 25 to engage the screw threads of these two threaded portions 22, 28, thus advancing the dart point 18 further into the aperture 26.

As this occurs, the tapered region 23 of the dart point 18 will protrude into the tapered rear portion 29 of the aperture 26. The tapered surfaces of the tapered region 23 of the dart point 18 and the tapered rear portion 29 of the aperture 26 will meet and press against each other, and this will have the effect of locking the dart point 18 firmly in place within the aperture 26.

This effect will partly be caused because, as the tapered surfaces engage each other and the dart point 18 continues to be screwed into the aperture 26, the forward-facing surfaces of the screw threads on the dart point 18 will be driven into contact with the rearward-facing surfaces of the screw threads of the aperture 26.

During the attachment process, the rear part of the gripping profile 19 will be received in the front portion 27 of the aperture 26. However, preferably the gripping profile 19 will not contact the shoulder surface 33 formed between the middle part 31 and front part 27 of the aperture 26.

Figure 7:
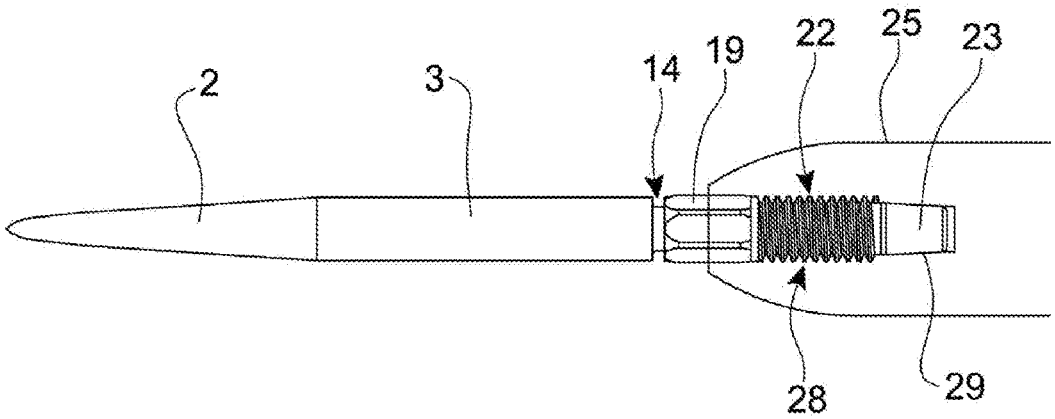
FIG. 7 shows the fourth dart point attached to the dart barrel of FIG. 6.

FIG. 7 shows the dart point 18 inserted into the aperture 26 of the barrel 25.

The skilled reader will appreciate that attaching the dart point 18 to the barrel 25 is straightforward. Removal of the dart point 18 from the barrel 25 will be similarly straightforward. In common with the second and third dart points 9, 15 discussed above, if a dart including the fourth dart point 18 is dropped onto a hard surface and the point breaks, it is likely to do so in the region of the groove 14, and it should therefore be possible to remove the remaining part of the dart point 18 without excessive difficulty.

The skilled reader will appreciate that dart points disclosed herein, and darts including these dart points, will confer significant advantages with respect to known equipment.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A dart point, the dart point having a distal end, a middle portion and a proximal end; wherein: the distal end is tapered to a point; the middle portion is substantially cylindrical and includes a weakened portion, comprising a region of the middle portion which is weaker than other regions of the middle portion; and the proximal end comprises a generally incompressible tapered retaining portion having a substantially continuous tapered retaining surface, being generally frusto-conical, wherein the taper becomes narrower in the direction passing from the distal end to the proximal end of the dart point, wherein the taper terminates in a blunt rear end, wherein the proximal end further comprises a joining part which, in use, fits into a dart barrel, and wherein the joining part further comprises a thread, useable to screw the dart point to a dart barrel, and wherein the joining part is between the middle part and the tapered retaining surface.

2. The dart point of claim 1, wherein the angle of the taper of the tapered retaining surface is from 1° to 20° to the longitudinal axis of the dart point.

3. The dart point of claim 2, wherein the angle of the taper of the tapered retaining surface is from 3° to 15°.

4. The dart point of claim 3, wherein the angle of the taper of the tapered retaining surface is from 6.5° to 7.5°.

5. The dart point of claim 1, wherein the angle of the taper of the tapered retaining surface is from 10° to 60° to the longitudinal axis of the dart point.

6. The dart point of claim 5, wherein the angle of the tapered retaining surface is between 30° and 60°.

7. The dart point of claim 1, wherein the generally incompressible tapered retaining portion comprises a first substantially continuous tapered retaining surface, being generally frusto-conical, wherein the taper becomes narrower in the direction passing from the distal end to the proximal end of the dart point, and a second substantially continuous tapered retaining surface, being generally frusto-conical, wherein the taper becomes narrower in the direction passing from the distal end to the proximal end of the dart point, wherein the first and second tapered retaining surfaces are spaced apart from each other in a direction parallel with the longitudinal axis of the dart point.

8. The dart point of claim 7, wherein the angle of taper of the first and second tapered retaining surfaces is the same or substantially the same, or wherein the angle of taper of the first tapered retaining surface is different from the angle of taper of the second tapered retaining surface.

9. The dart point of claim 1, wherein the tapered retaining surface is substantially straight in cross-section.

10. The dart point of claim 1, wherein the middle portion includes a gripping profile, which comprises a region of the middle portion having a cross-sectional shape including one or more flat or substantially flat surfaces.

11. A dart point, the dart point having a distal end, a middle portion and a proximal end; wherein:

the distal end is tapered to a point;

the middle portion is substantially cylindrical and includes a weakened portion, comprising a region of the middle portion which is weaker than other regions of the middle portion, and preferably wherein the weakened portion has a cross-section which is thinner in at least one direction compared to the cross-section of regions of the middle portion immediately surrounding the weakened portion; and the proximal end comprises a generally incompressible tapered retaining portion having a substantially continuous tapered retaining surface, being generally frusto-conical, wherein the taper becomes narrower in the direction passing from the distal end to the proximal end of the dart point.

12. The dart point of claim 11, wherein the weakened portion comprises one or more grooves formed in the middle portion.

13. The dart point of claim 10, wherein the weakened portion has a cross-section which is thinner in at least one direction compared to the cross-section of regions of the middle portion immediately surrounding the weakened portion.

14. The dart point of claim 13, wherein the weakened portion is further towards the point than the gripping profile.

15. A dart point, the dart point having a distal end, a middle portion and a proximal end; wherein: the distal end is tapered to a point; the middle portion is substantially cylindrical and includes a weakened portion, comprising a region of the middle portion which is weaker than other regions of the middle portion; and the proximal end comprises a generally incompressible tapered retaining portion having a substantially continuous tapered retaining surface, being generally frusto-conical, wherein the taper becomes narrower in the direction passing from the distal end to the proximal end of the dart point, wherein the proximal end further comprises a joining part which, in use, fits into a dart barrel, and wherein the joining part further comprises a thread, useable to screw the dart point to a dart barrel, and wherein the tapered retaining surface is between the middle portion and the joining part.

16. The dart point of claim 2, wherein the angle of the taper of the tapered retaining surface is from 5° to 10°.

17. The dart point of claim 5, wherein the angle of the tapered retaining surface is between 40° and 50°.

* * * * *